US010953289B2

(12) United States Patent
Burke

(10) Patent No.: US 10,953,289 B2
(45) **Date of Patent: *Mar. 23, 2021**

(54) LIGHTWEIGHT INFLATABLE DEVICE FOR PLAY OR TRAINING

(71) Applicant: Joseph Gerard Burke, Yorba Linda, CA (US)

(72) Inventor: Joseph Gerard Burke, Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/248,638

(22) Filed: Jan. 15, 2019

(65) Prior Publication Data

US 2019/0201749 A1 Jul. 4, 2019

Related U.S. Application Data

(63) Continuation-in-part of application No. 15/788,228, filed on Oct. 19, 2017, now Pat. No. 10,179,266,
(Continued)

(51) Int. Cl.
*A63B 37/06* (2006.01)
*A63B 69/20* (2006.01)
(Continued)

(52) U.S. Cl.
CPC ..... *A63B 37/06* (2013.01); *A63B 37/004* (2013.01); *A63B 37/10* (2013.01); *A63B 41/02* (2013.01);
(Continued)

(58) Field of Classification Search
CPC ..... A63B 37/06; A63B 71/0054; A63B 41/02; A63B 37/004; A63B 37/10;
(Continued)

(56) References Cited

U.S. PATENT DOCUMENTS 1,352,047 A * 9/1920 Boje, Jr. ..... A63H 3/06 446/183
2,223,091 A * 11/1940 Bresnahan ..... A63B 65/10 482/21
(Continued)

OTHER PUBLICATIONS

"BoPET", <<https://en.wikipedia.org/wiki/BoPET>>, retrieved on Sep. 2, 2020. (Year: 2020).*
(Continued)

*Primary Examiner* — Steven B Wong
(74) *Attorney, Agent, or Firm* — Scorr R. Hansen; Viking IP Law

(57) ABSTRACT

A device has a lightweight inner bladder and an outer layer that covers the inner bladder. The inner bladder bunches up, "crunches," becomes pleated, folded or the like against the inner surface of the outer layer. The bunched up surface of the inner bladder may be flattened and/or reconfigured upon impact, thereby absorbing energy. The bunched up inner bladder may create an uneven surface on the outer layer thereby altering the manner through which the device travels through the air. The device may be configured for any of a variety of sports or games such as, for example, a simulated soccer ball, football, rugby ball, baseball and/or softball, a tennis ball, a beachball or other oversized ball, a golf ball, a flying disc, a weighted punching bag, or any of a wide variety of devices for play and/or training.

20 Claims, 17 Drawing Sheets

Related U.S. Application Data which is a continuation-in-part of application No. PCT/US2017/026858, filed on Apr. 10, 2017, and a continuation-in-part of application No. 15/296,025, filed on Oct. 17, 2016, now abandoned.

(51) Int. Cl.

| | |
|---|---|
| ***A63B 69/36*** | (2006.01) |
| ***A63B 69/38*** | (2006.01) |
| ***A63B 65/10*** | (2006.01) |
| ***A63B 41/02*** | (2006.01) |
| ***A63B 71/00*** | (2006.01) |
| ***A63B 37/00*** | (2006.01) |
| ***A63B 37/10*** | (2006.01) |
| ***A63H 33/18*** | (2006.01) |
| *A63B 69/00* | (2006.01) |
| *A63B 67/00* | (2006.01) |

(52) U.S. Cl.

CPC ..... *A63B 71/0054* (2013.01); *A63H 33/18* (2013.01); *A63B 65/10* (2013.01); *A63B 67/002* (2013.01); *A63B 69/002* (2013.01); *A63B 69/0002* (2013.01); *A63B 69/20* (2013.01); *A63B 69/36* (2013.01); *A63B 69/38* (2013.01)

(58) Field of Classification Search

CPC ... A63B 69/0002; A63B 67/002; A63B 69/20; A63B 69/36; A63B 69/38; A63B 65/10; A63B 69/002; A63B 21/0603; A63B 2225/76; A63B 2071/026; A63B 2225/62; A63B 2243/0066; A63B 43/002; A63B 41/08; A63B 45/00; A63B 43/008; A63B 2043/001; A63B 41/12; A63B 41/04; A63B 2243/0025; A63B 2243/0095; A63B 71/04; A63B 2209/00; A63B 2071/0694; A63B 2225/01; A63H 33/18; A63H 3/06

USPC ..... 473/598–603, 451, 604, 605; 446/46–48, 446/220–226

See application file for complete search history.

(56) References Cited

U.S. PATENT DOCUMENTS

| | | | | | |
|---|---|---|---|---|---|
| 2,668,394 | A * | 2/1954 | Auzin | A63H 3/24 | 446/183 |
| 2,864,201 | A * | 12/1958 | Leise | A63B 65/10 | 446/46 |
| 3,091,053 | A * | 5/1963 | Growald | A63H 3/00 | 446/14 |
| 3,942,793 | A | 3/1976 | Lombardo | | |
| 4,253,672 | A * | 3/1981 | Milzoff | A63H 33/18 | 473/588 |
| 4,337,944 | A | 7/1982 | Massino | | |
| 4,462,589 | A | 7/1984 | Morgan | | |
| 4,542,902 | A | 9/1985 | Massino | | |
| 4,616,827 | A * | 10/1986 | Bergland | A63B 43/002 | 273/DIG. 8 |
| 4,693,695 | A * | 9/1987 | Cheng | A63H 27/10 | 446/220 |
| 4,738,450 | A | 4/1988 | Wexler | | |
| 4,758,198 | A * | 7/1988 | Ishiwa | A63H 3/06 | 137/512 |
| 4,834,382 | A | 5/1989 | Spector | | |
| 4,898,561 | A * | 2/1990 | Nottingham | A63H 3/06 | 446/220 |
| 5,035,426 | A | 7/1991 | Spector | | |
| 5,138,721 | A | 8/1992 | Spector | | |
| 5,286,020 | A | 2/1994 | Caruso | | |
| 5,287,561 | A * | 2/1994 | Spector | A42B 1/206 | 2/175.1 |
| 5,335,907 | A | 8/1994 | Spector | | |
| 5,380,002 | A | 1/1995 | Spector | | |
| 5,462,273 | A | 10/1995 | Spector | | |
| 5,522,757 | A * | 6/1996 | Ostrowski | A63B 43/02 | 446/220 |
| 5,588,648 | A | 12/1996 | Stebbins | | |
| 5,961,426 | A * | 10/1999 | Spector | A63H 3/06 | 446/220 |
| 5,984,753 | A * | 11/1999 | Perez | A63H 33/18 | 446/46 |
| 6,402,647 | B1 | 6/2002 | Haseltine | | |
| 7,704,194 | B1 * | 4/2010 | Chen | A63B 69/208 | 482/87 |
| 7,740,552 | B2 | 6/2010 | Spector | | |
| 8,021,252 | B2 * | 9/2011 | Goedoen | A63B 41/08 | 473/604 |
| 8,342,991 | B2 | 1/2013 | Spector | | |
| 9,242,149 | B2 | 1/2016 | Carter | | |
| 10,179,266 | B2 * | 1/2019 | Burke | A63B 41/02 | |
| 2002/0077201 | A1 | 6/2002 | Davies | | |
| 2004/0087396 | A1 | 5/2004 | Chan | | |
| 2007/0060426 | A1 | 3/2007 | Maziarz | | |
| 2008/0268990 | A1 | 10/2008 | Todokoro | | |
| 2008/0287218 | A1 | 11/2008 | Freund | | |
| 2009/0286632 | A1 | 11/2009 | Laliberty | | |
| 2010/0317472 | A1 | 12/2010 | Maziarz | | |
| 2012/0283050 | A1 | 11/2012 | Brundage | | |
| 2015/0126312 | A1 | 5/2015 | Mayer | | |

OTHER PUBLICATIONS

Websites: www.victury.com and www.ollyball.com Video: https://youtu.be/GXIWpSLRFac.

* cited by examiner

LIGHTWEIGHT INFLATABLE DEVICE FOR PLAY OR TRAINING

CROSS-REFERENCE TO RELATED APPLICATIONS

This application is a continuation-in-part of U.S. patent application Ser. No. 15/788,228, filed on Oct. 19, 2017 and entitled "Lightweight Training Ball With Inner and Outer Layers," which is a continuation-in-part of Patent Cooperation Treaty application PCT/US17/26858, filed Apr. 10, 2017 entitled "Training Ball for Indoor Use and Method for Training" and which designates the United States, and a continuation-in-part of U.S. patent application Ser. No. 15/296,025, filed Oct. 17, 2016, entitled "Training Ball for Indoor Use and Method for Training With a Lightweight Ball." This application claims the benefit of U.S. Provisional Patent Application Ser. No. 62/655,397, filed on Apr. 10, 2018 and entitled, "Lightweight Device for Play or Training with Inner and Outer Layers." All of the foregoing are incorporated by reference herein.

TECHNICAL FIELD OF THE INVENTION

The present invention relates to a lightweight ball, flying disc, punching bag, and/or other device that may be used for exercise and/or play and, in particular, to a lightweight device having an outer layer and an inner bladder.

BACKGROUND

Athletes who play sports that include hitting or kicking a ball tend to spend many hours training. There are many devices to facilitate training, such as balls attached to bungee cords, balls attached to fulcrums, rolling half-spherical balls and rebounding nets. These devices are often used outdoors or in an indoor stadium or other training space. When such devices are used in most indoor settings, damage to walls, ceilings, other structural components—as well as to related objects, such as lamps, pictures, windows, drinking glasses, etc.—can occur.

As an alternative and in order to limit the possibility of damage, the athlete could use a balloon or beach ball indoors. The exterior of balloons and beach balls do not replicate the exterior of an actual sports ball. Also, the valve, balloon knot and shape can cause the balloon or beach ball to spin lopsidedly and out of balance.

What is needed is a ball or other device for training or play that has a shape and weight that allows for an accurate simulation of regulation counterpart, while limiting the potential damage in an indoor environment such as a house.

BRIEF SUMMARY

In one embodiment, a ball for training and/or play has a flexible outer layer and an inflatable inner bladder. The outer surface of the inner bladder is bunched up against the inner surface of the outer layer. At least a portion of the bunched up outer surface of the inner bladder is adapted to at least partially change configuration to absorb energy upon impact. The bunched up inner bladder may create an uneven surface on the outer layer, such as a ripple, for example. The uneven surface of the outer layer is adapted to reduce the speed of ball as it travels through the air. The bunched up inner bladder may act as a cushion, and the inner bladder may be made of a metalized film, for example.

Various other features may be added, either in combination or individually. The inner bladder may be partially inflated, or may be fully inflated.

In another embodiment, a ball for training and/or play includes a flexible outer layer having a diameter, and an inflatable inner bladder, the inner bladder having a diameter greater than the diameter of the outer layer. The outer surface of the inner bladder is bunched up against the inner surface of the outer layer. At least a portion of the bunched up outer surface of the inner bladder is adapted to at least partially change configuration to absorb energy upon impact. The change of configuration may be described as flattening, unbunching, and/or expanding the bunched surface.

Added features may include one or more of the following. The inner bladder may be fully inflated or partially inflated. The bunched up inner bladder may create an uneven surface on the outer layer, such as a ripple or other effect. The uneven surface may be adapted to reduce the speed of ball as it travels through the air. The bunched up inner bladder may act as a cushion. The inner bladder may be formed with a metalized film. The exterior layer may be formed from lightweight high-density polyethylene fibers.

In a further embodiment, a ball for training and/or play includes a flexible outer layer having a diameter and an inflatable inner bladder. The outer surface of the inner bladder may be bunched up against the inner surface of the outer layer. At least a portion of the bunched up outer surface of the inner bladder is adapted to at least partially change configuration to absorb energy upon impact.

Examples of embodiments of devices according to the present invention are simulated soccer balls, footballs, rugby balls, baseballs and/or softballs, beachballs or other oversized balls, golf balls, flying discs, tennis balls, and punching bags that may optionally be weighted. The present invention extends to items that are irregular in shape, such as dolls, cars, and the like, in which the exterior layer and/or interior bladder may have an irregular shape.

In the flying disc embodiment, the disc may have a generally circular upper outer layer, a generally circular lower outer layer, and an interior bladder, the upper and lower outer layers being joined at the edges. The edge of the disc may be reinforced with a resilient ring, such as for example spring steel wire, extending about the edge of the disc on the interior of the device.

The punching bag embodiment may be weighted at the bottom, as with a pocket in which weights, sand, or the like is placed. Alternatively, the exterior layer of the punching bag may be sewn, adhered, or otherwise secured to a weighted base. The weighted base serves to keep the punching bag on the ground and/or to limit the travel of the punching bag upon impact.

Again, the disclosed concept includes variations, and the optional features noted above may be added to embodiments of the invention, either alone or in various combinations as appropriate.

A further understanding of the nature and advantages will become apparent by reference to the remaining portions of the specification and drawings.

DETAILED DESCRIPTION

In one embodiment of the invention, a ball according to the present invention is designed for indoor and in-home use as it is a regulation-sized, spherical ball that weighs slightly heavier than a latex balloon. Alternatively, the ball can also be used competitively in a game or sport.

In a preferred embodiment, the ball is constructed of two or more layers of material that are designed to spin, balance and physically react similarly to a regulation soccer or volleyball that conforms to specifications of a standards body. In one embodiment, the ball is inflated with a standard drinking straw that is inserted into a self-closing valve on the inflation port, the inner bladder being, in one embodiment, a balloon of a metalized film, such as for example Mylar or Mylar-type material. The ball is filled with air, nitrogen, helium or other gas that, in combination with materials and/or ball construction, produce a desired "gravity" or weight.

Figure 2:
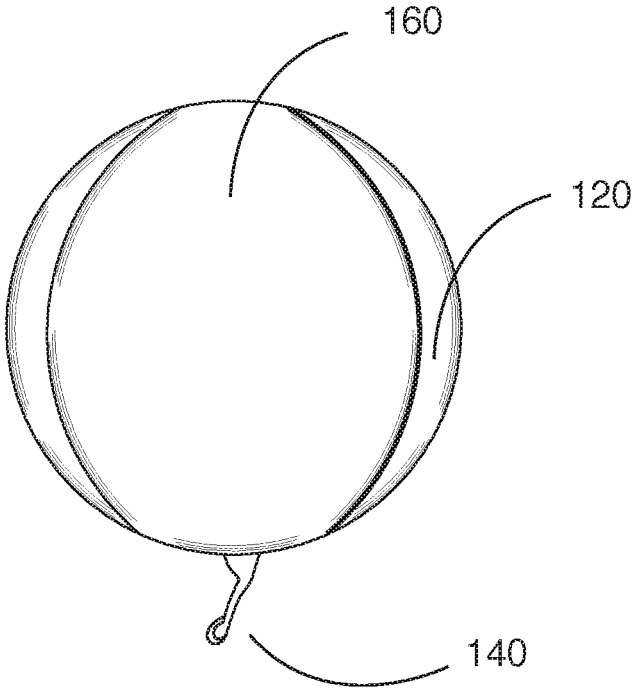
FIG. 2. is a view of the ball of FIG. 1 in which the inner bladder is exposed for illustrative purposes and an inflation stem is shown extended so that the bladder may be inflated.
Figure 3:
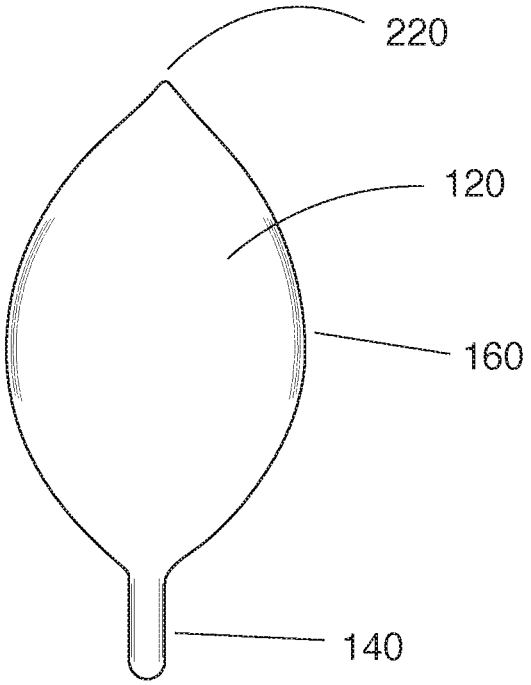
FIG. 3 illustrates one embodiment of an uninflated inner bladder.

Considering the drawings of a presently preferred embodiment, a training ball 100 includes an inner bladder 120 (FIG. 2) that has an inflation port 140 tucked within opening 150. The inflation port 140 may be pulled out from opening 150 for inflation or deflation of the ball 100 (FIG. 2). The inflation port 140 allows the bladder 120 (FIGS. 2, 3) to be filled with air, nitrogen, helium or other gas, as desired. The port 140 includes a valve, which may be visible or not depending on the manufacturer and material(s) used. As noted, a straw or other device may optionally be inserted into the port 140 to facilitate inflation by blowing into the bladder. If a straw, it may optionally be custom-made for use with the ball.

Figure 1:
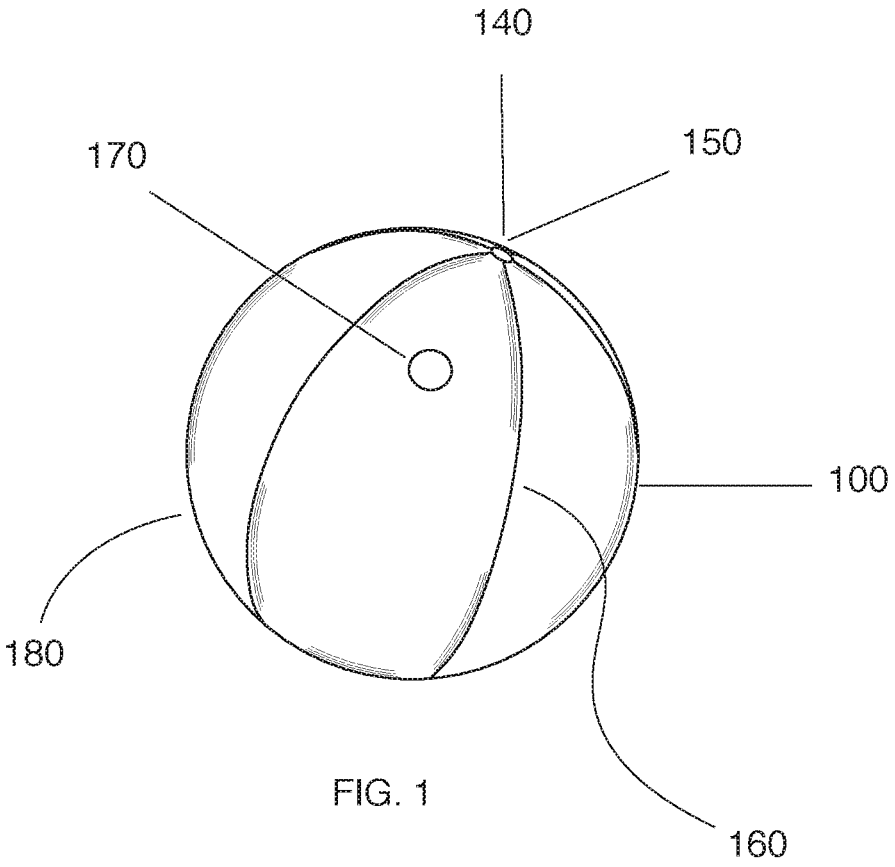
FIG. 1 illustrates a training ball according to one embodiment of the invention in which the ball has multiple panels, an inflation port to fill an inner bladder, and indicia printed thereon.

The ball 100 may also include design and visuals that may be, for example, lines (printed, molded, intruded or extruded) or other shapes, that give a visual reference to the user and/or give the ball balanced properties when the ball is spinning. In FIG. 1, lines 160 may be imprinted on or molded into the exterior surface of outer layer 180 of the ball. Although the lines 160 are shown to extend about the circumference in a straight manner, the lines may alternatively be curved and/or another shape. Alternatively, the lines 160 may be seam lines connecting multiple panels to form the exterior surface of the ball. Indicia 170 which, in this case, is a printed colored dot, may be included to give the user a visual effect that may enhance the training such as, for example, allowing the user to better view the spin of the ball during use.

The ball is best produced through a material formation device. This could be but not limited to plastic injection molding, foam molding, vulcanization or other technique specific to manufacturing that accomplishes the size and weight requirements of the training system.

The outer layer 180 of the ball 100 may have measurements that match the circumference of an actual sports ball. That is, as just one non-limiting example, the training ball may have a circumference of 68-70 cm to correspond to the circumferences of a regular sports ball. The weight of the ball may be varied. There could be, for example, a set of balls that have weights between less than 1 ounce up to about 8 ounces to simulate different levels of "gravity." The outer layer 180 is typically made of a lightweight synthetic woven material, or other suitable lightweight material.

In one specific embodiment, the training ball 100 includes a heat seamed, 4-panel inner bladder 160 that inflates to about 70 cm in circumference. The bladder 160 is made of a material such as Mylar or other material suitable for a bladder. The exterior may be a sewn, 6-panel outer shell that is about 70 cm in circumference when the bladder is inflated. One non-limiting example of a suitable exterior surface is one made of Tyvek 1443R and/or other types of Tyvek or synthetic woven materials or other suitable materials may be used.

Generally, the Tyvek that may be used in some embodiments of the present invention is made with very fine polyethylene fibers bonded by heat and pressure. It is soft and fabric-like, is flexible and has tear resistance. Sewing, gluing, and, to a limited extent, ultrasonic seaming and heat sealing may be used in fabricating materials using these styles. The surface may be corona treated or otherwise prepared such that a user of some embodiments of the present invention may color and customize the surface with permanent marker, water-based marker, and/or crayons and the like. Typically, corona treatment oxidizes the surface and increases the wettability, receptivity, and retention to inks and other materials used in hand-coloring.

In another non-limiting embodiment, the inner bladder has an uninflated dimension of about 7 inches or 17.5 centimeters at its widest point, and a length of about 14 inches or 35 centimeters, not including the length of the inflation port. The inner bladder is then inflatable to a circumference of about 70 cm.

Considering relative diameters, the inner bladder—before being placed within the outer covering and unconstrained by the outer covering—will typically have an inflated diameter that is greater than the diameter of the outer covering. This allows the inner bladder to bunch up against the inner surface of the outer covering when the inner bladder is inflated inside the outer covering. In one non-limiting embodiment, an inflated diameter at least 1.25 times greater than the diameter of the outer layer. As there are many different types of devices disclosed herein, the ratio of maximum diameter of the inner bladder to the maximum diameter of the outer covering will vary depending on the type of ball/device and the amount of crunch effect that is desired. For example, in one soccer ball embodiment, an inner bladder has a maximum uninflated diameter of about 15.5 inches before being inserted into the outer covering, which has an uninflated diameter of about 11.5 inches. The ratio of maximum diameter of uninflated inner bladder to maximum diameter of uninflated outer covering is roughly 1.35.

As noted, the maximum diameter of the inner bladder of one embodiment of a soccer ball is measured in the center region of the bladder, as the bladder in one embodiment is oblong in shape when uninflated. Also, the bladder may be made with multiple panels, for example, such that when inflated the maximum diameter is measured from corner-to-corner of the bladder. Consequently, in one non-limiting embodiment, the maximum corner-to-corner diameter of a four-panel inflated and unconstrained BoPET inner bladder is about 16 inches. When the BoPET inner bladder is insider the outer layer and inflated, the maximum diameter of the ball is about 11.5 inches. Thus, in this specific embodiment the ratio of unconstrained inflated inner bladder maximum diameter to maximum diameter of the inflated ball is about 1.39. In another ball embodiment, the ratio is about 1.26. In both cases, the ratio is greater than about 1.25. In one set of embodiments, the range is between about 1.27 and about 1.75, although this range is non-limiting.

As can be seen, in many embodiments, both the unconstrained maximum diameter of the uninflated and inflated inner bladder are greater than the maximum diameter of an uninflated and relatively inelastic outer cover (e.g. a cover made of Tyvek 1443R or other relatively inelastic material). The ratios of bladder dimension to outer cover dimension will vary among the different embodiments, and can be chosen to create different effects, such as causing an irregular surface on the outer cover, the desired type of cushioning, and so forth.

Also, in one embodiment, the material of the outer layer (e.g., in one embodiment, Tyvek) stretches very little as the inner bladder is inflated, helping to facilitate the crunch/cushioning effect.

The inflatable bladder 160 is lightweight, and includes an inflation valve or port 14 that is a self-closing. The valve typically does not add any significant weight to the ball and does not alter the balance of the spin of the ball. The outer surface 200 of the bladder is situated within the outer layer 180. The bladder may optionally be secured within the outer layer 180 with adhesive, for example, applied at point 220 and/or at other locations on the bladder.

The exterior surface of outer layer 180 may also include designs and/or visuals, such as lines 160. For example, the exterior surface may include lines (printed, molded, intruded or extruded), that give a visual reference to the user and/or give the ball balance properties when the ball is spinning. The exterior surface may also include printed indicia that, for example, assists the user in seeing the ball or a portion thereof.

Figure 4:
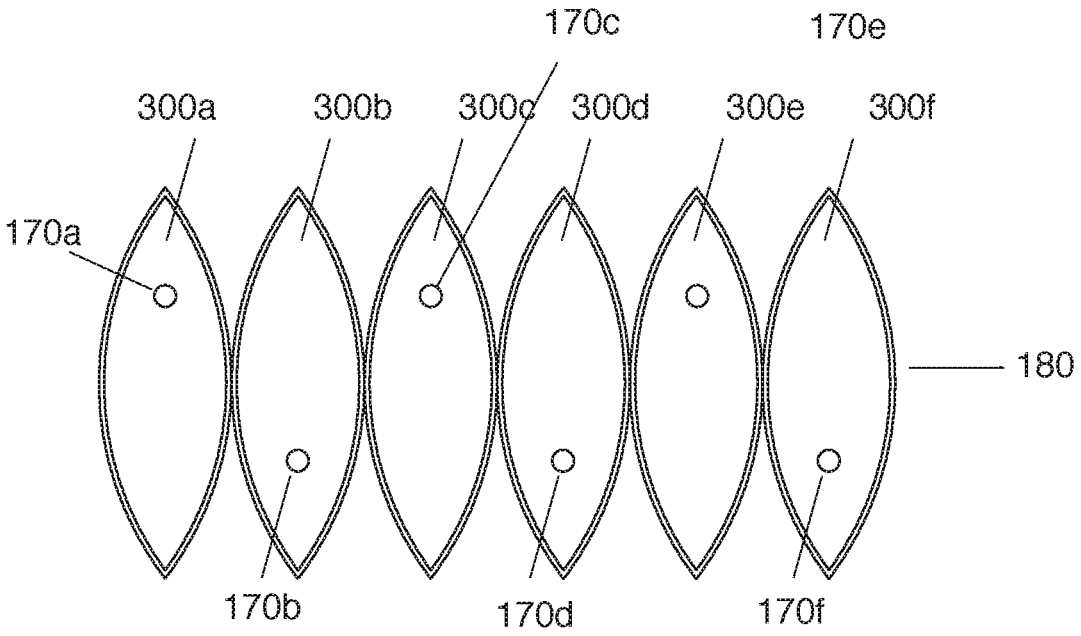
FIG. 4 illustrates panels that may be sewn together to form an exterior covering of the training ball.
Figure 5:
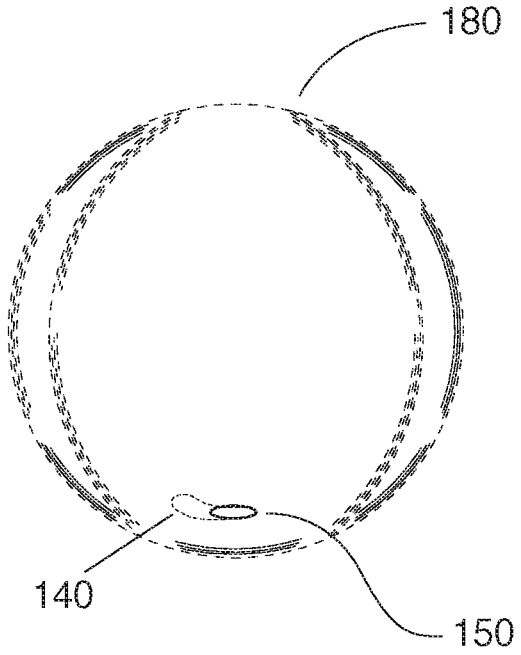
FIG. 5 illustrates the training ball of FIG. 2 after inflation and with the inflation port tucked into exterior surface of the ball.

FIG. 4 illustrates a panel of portions 300*a-f* which, when sewn or otherwise manipulated and secured forms an exterior layer 380. The precise nature of each of the panels 30*a-f* may vary for different types of balls and/or the desired properties of the ball. For example, the exterior surface of the outer layer 380 may be roughened and/or have shapes extending from or indented into the surface. The surface may mirror the surface of the type of ball it seeks to replicate, having an external surface that appears to be a soccer ball, a volleyball, or whatever type of ball of the sport for which the user is training.

In one embodiment, using the ball would simulate playing with an actual sports ball (e.g. a soccer ball) in a low-gravity environment. Being lightweight and having a low gravity motion, the ball may "float" when hit or kicked, and give the user(s) time to react and adjust their movements for increased skill training, fitness and/or physical therapy, for example. In that regard, various embodiments of a training ball according to the present invention may have different weights. As the user(s) increases skill level, the user may use a heavier ball with less "low-gravity" effect. This brings the weight of the ball closer to a real regulation sports ball. So, for example, whereas a regulation soccer ball may be 16 ounces in weight, for example, a training ball according to the present invention may range from about 0.3 ounces to about 8 ounces. The heavier ball may more closely replicate an actual soccer ball, but still be lighter in weight and more suitable than an actual soccer ball for training indoors.

Considering the invention further, an athlete is provided with a "reduced-gravity" ball that allows the user to more easily react to the ball's movement and accelerating skills than a regulation ball. A training system may be provided to coach the user through a series of drills and fitness exercises with the ball. The "anti-gravity" ball may come in several weights that train the user by gradually using heavier balls that have more "gravity." In one embodiment, the training ball is safe indoors, similar to playing with a balloon but having an outer surface that better simulates an actual playing ball. In this respect, balls according to the present invention may be used by athletes, coaches, military instructors, fitness seekers, and/or persons with injuries or disabilities. The training ball may lead to rapid improvement of ball-handling skills, hand-eye coordination, and/or fitness, may be used in physical therapy. Embodiments of the invention may be adapted to be used indoors during inclement weather.

One particular embodiment (FIGS. 5-8) includes an inner bladder 120 made of a metallized film such as Mylar, for example, or other acceptable material, and an outer layer 180. The bladder 120, when fully inflated, would have a diameter greater than that of the outer layer 180. The outer layer 180 constrains the degree to which the inner bladder 120 can be inflated. Consequently, there is a surplus of material in the inner bladder (FIG. 7), creating a "crunched" or bunched up surface 200 of the inner bladder. This may optionally alter the surface of the outer layer 180, and provide unique cushioning or other properties when the ball is kicked or hit. The bladder may be a balloon, most typically a balloon made from a metalized material such as Mylar.

For instance, the surface of the outer layer may become uneven, such as the surface of the inner bladder creating ripples or other shapes on the surface of the outer layer. This may create additional air resistance when the ball moves through space, slowing the ball and/or affecting its trajectory, such as causing the ball to curve while in flight. Unlike a smooth-surfaced beach ball, sports ball or balloon, this additional air resistance, or skin friction, slows the movement of the ball. The ball may be adapted to react and spin like a typical sports ball.

Figure 7:
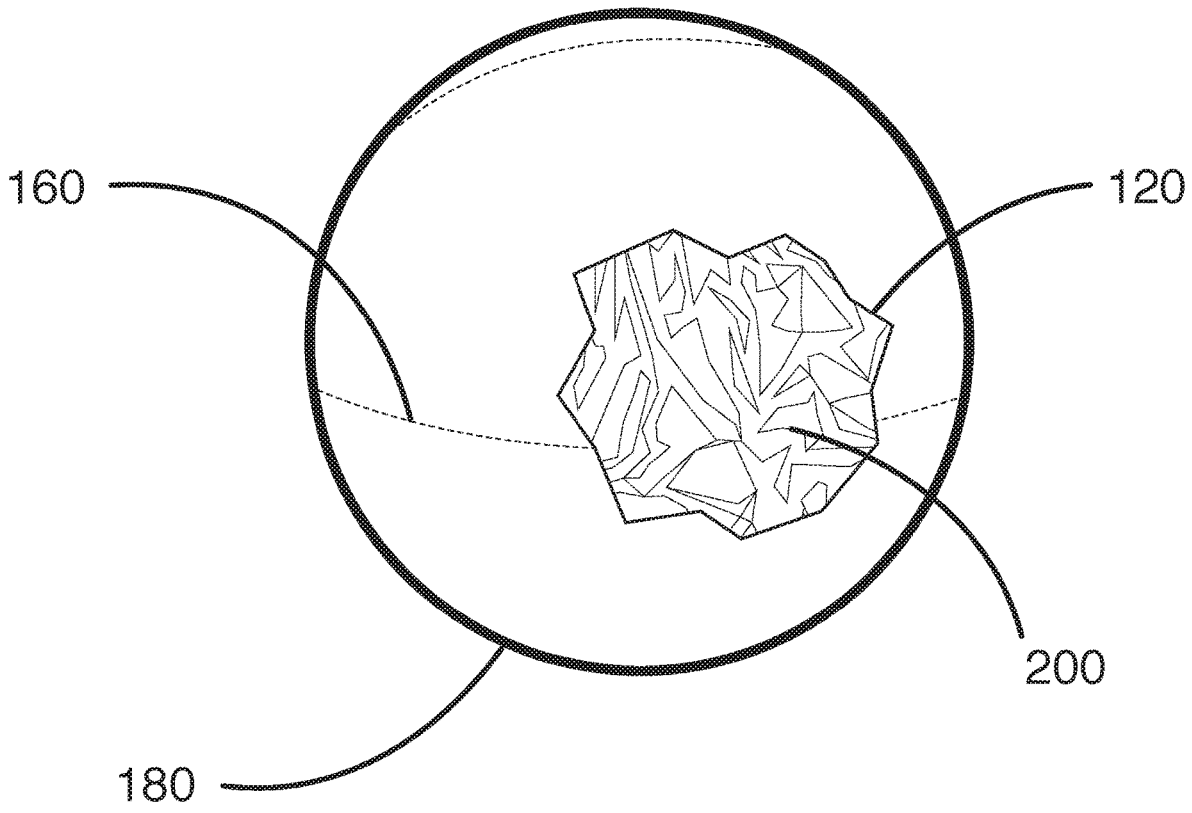
FIG. 7 is a cut-away view illustrating the bunched up surface of the inner bladder against the inner surface of the outer layer.
Figure 8:
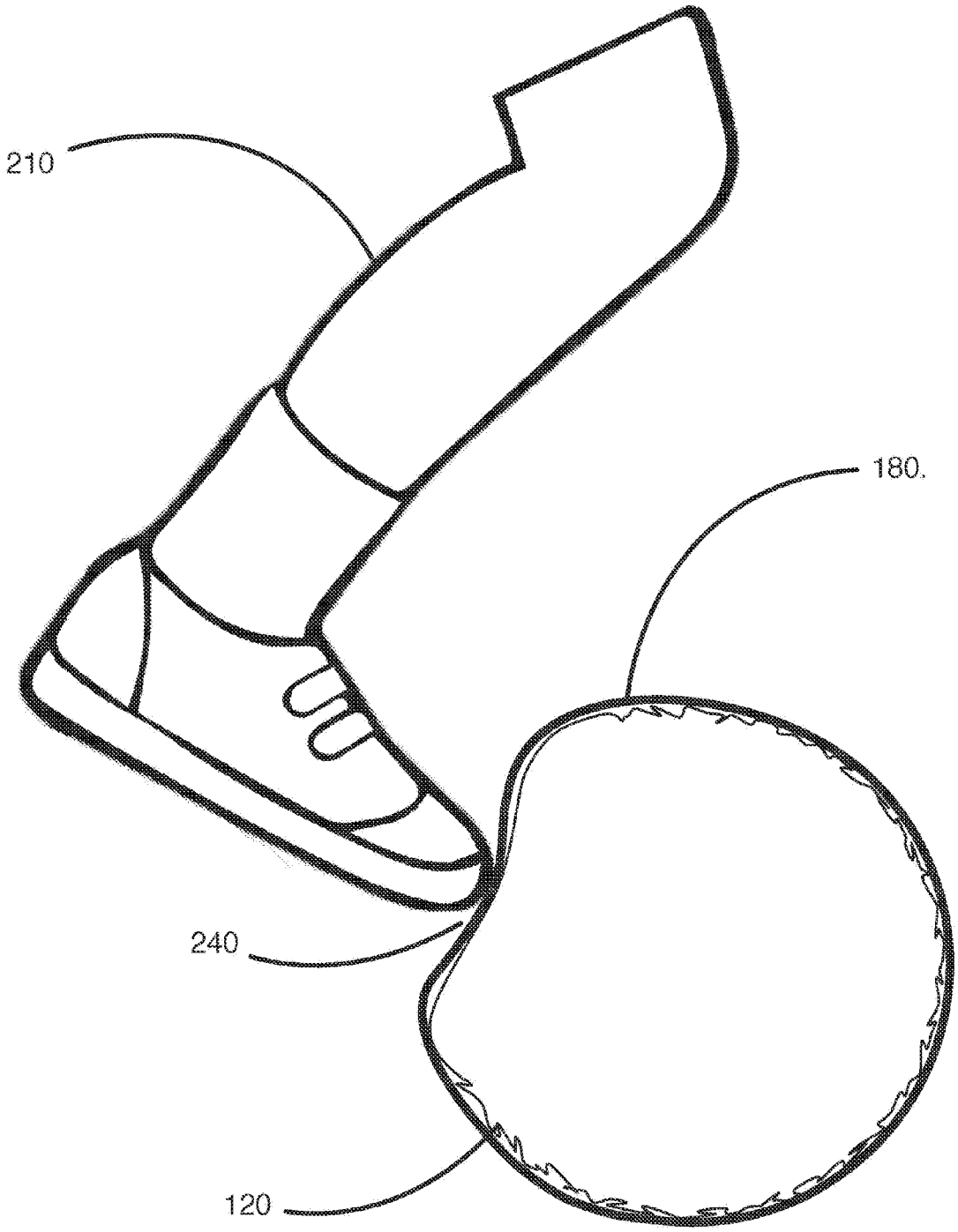
FIG. 8 illustrates a flattening of the bunched up surface of the inner bladder when the ball is impacted.
Figure 9:
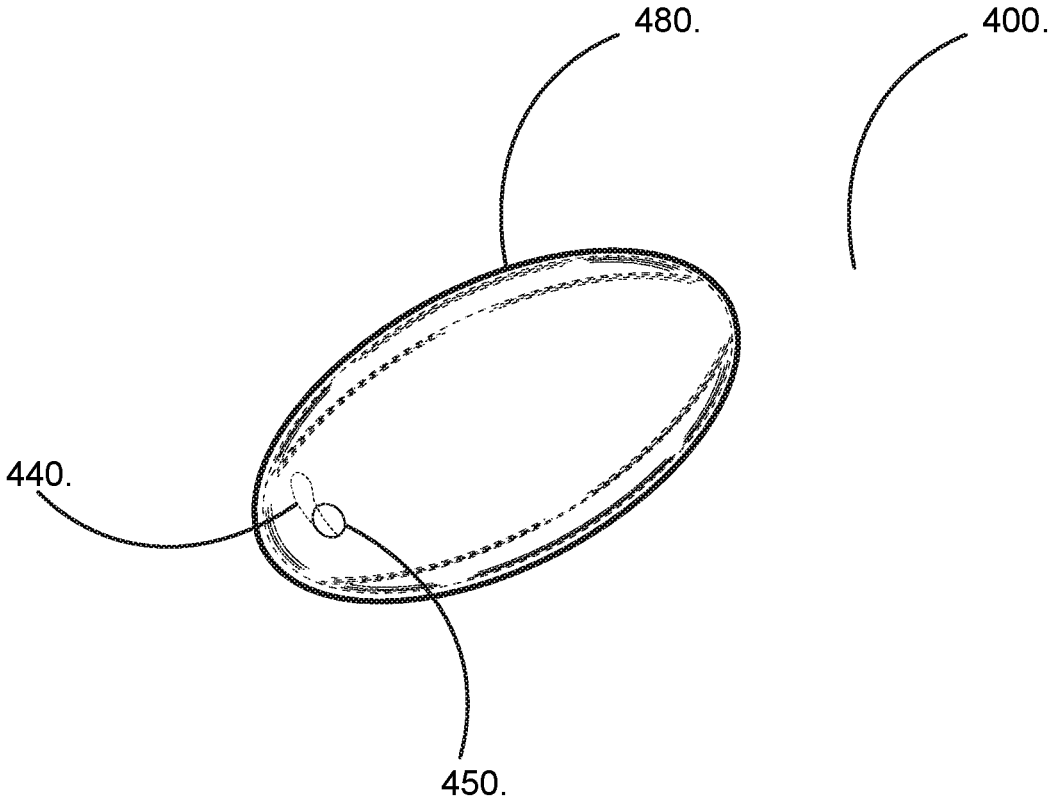
FIG. 9 illustrates a football embodiment of the present invention.

In one embodiment illustrated in FIG. 8, the outer casing/layer 180 of the ball 100 is constructed of a durable and lightweight material. The interior bladder 120 is an oversized bladder that, when inflated, bunches and "crunches" up the excess material to create folds and/or other structures against the inner surface of the outer casing (FIG. 7). When a hand, foot or object impacts the ball at an impact area 40 (FIG. 8), the bunched material of the inner bladder allows for shock absorption. That is, the bunched material may "unbunch" and/or flatten and/or expand or the like, so as to absorb energy. As FIG. 9 illustrates, in one embodiment of the present invention, the bunched material 200 on the inner bladder 120 changes configuration, e.g. flattens and/or expands and/or "unbunches" upon impact, absorbing energy and dampening the "trampoline effect" of the impact on the ball. See FIG. 8 for a foot kicking one embodiment of a ball according to the present invention at point 240.

In another embodiment, the surface 200 of the inner bladder becomes bunched up and/or has folds when the inner bladder is underinflated. This is an alternative approach to creating an uneven surface on the inner bladder.

American Football

Considering an American football version of a training ball (FIGS. 9-11), as just one non-limiting example, the ball 400 may have a circumference of 22 inches at its center and a length of 11 inches tip-to-tip to correspond to the circumferences of a regular football. Generally, the football is oblong in shape and may optionally have pointed ends to further simulate the appearance of a regulation football.

Considering specific features, FIG. 9 illustrates that the ball 400 includes an outer surface 480, an inflation port 440, and an inflation port opening 450.

Figure 10:
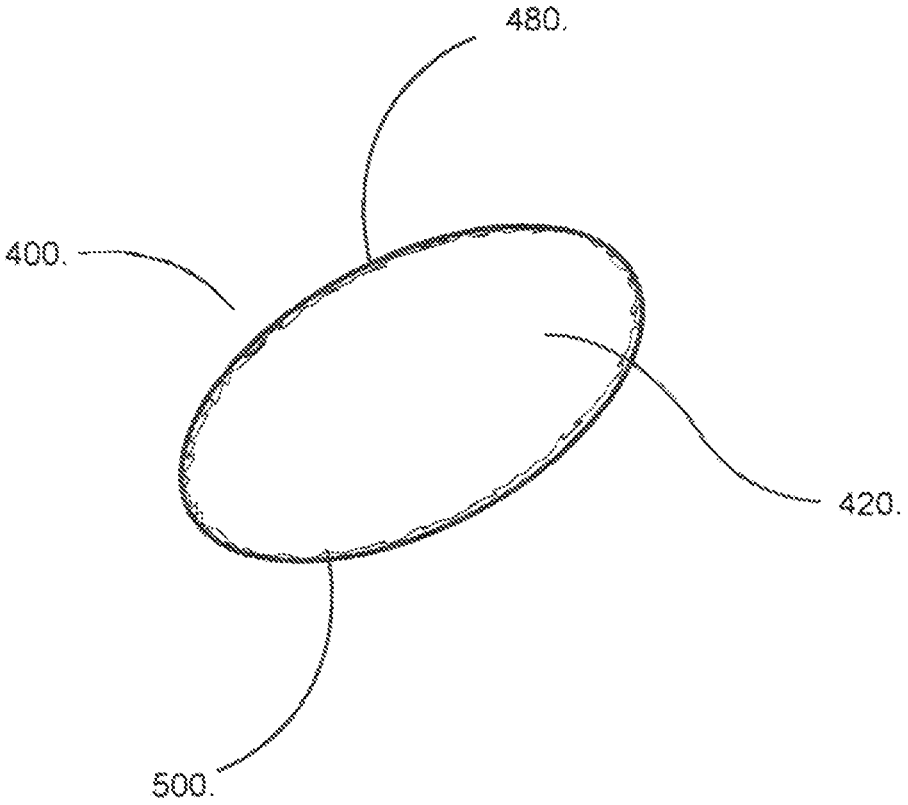
FIG. 10 is a cutaway view of the football of FIG. 9.
Figure 11:
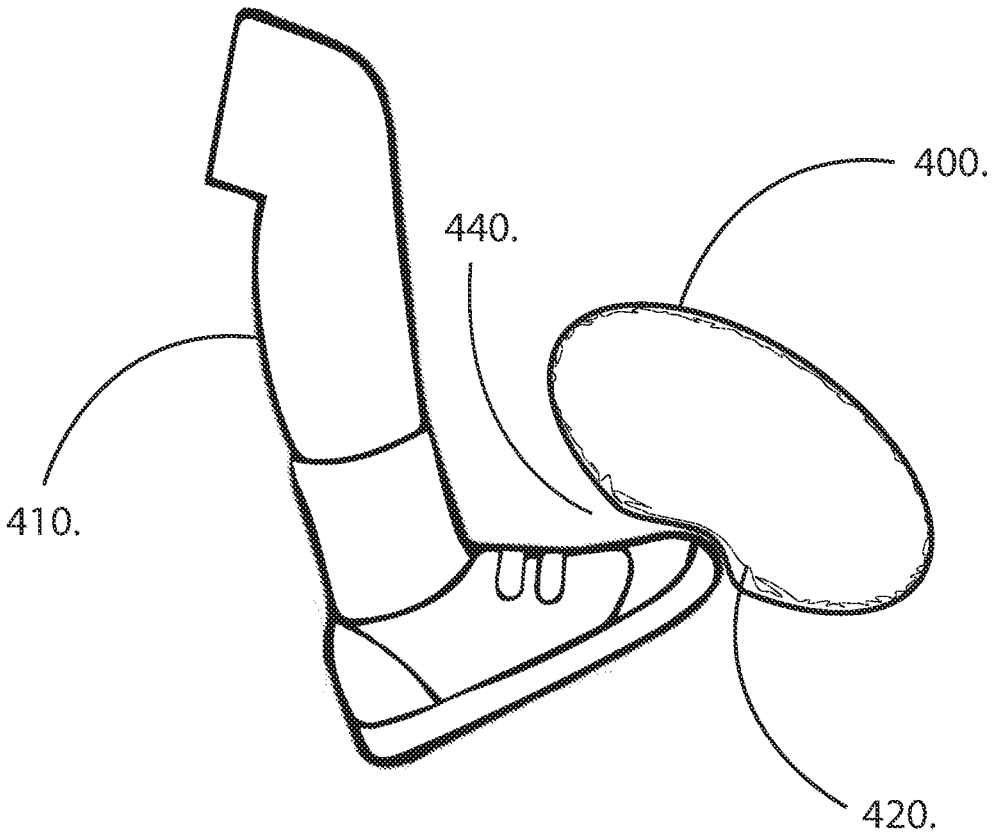
FIG. 11 is a cross-section view of the football embodiment of FIG. 9 illustrating the interior of the ball as it is kicked.

FIG. 10 illustrates an oblong exterior layer 480 and an oblong interior bladder 420. In this embodiment, the interior bladder is sized such that inflation of the bladder creates a bunching up of the surface 500 of the interior bladder where the interior bladder 420 meets the exterior layer. This bunching up of the surface of the interior bladder creates an energy-absorbing system. FIG. 11 illustrates that the bunched-up surface of the inner bladder flattens out in a region 440 at which the football is impacted by a foot 410 kick, for example, thereby absorbing energy from the impact and modifying the response of the ball.

In one embodiment, using the football of FIGS. 9-11 would simulate playing with an actual football but in a low-gravity environment. Being lightweight and having a low gravity motion, the ball may "float" when hit or kicked, and give the user(s) a simulated but accurate ball reaction and spin of an actual kicked football in a field goal or punting situation. For instance, whereas a regulation football (e.g. a football that conforms to regulations as to dimension and/or weight) may be 14 ounces in weight, for example, a training ball according to the present invention may range from about 0.3 ounces to about 8 ounces. A heavier training ball may more closely replicate an actual football, but still be lighter in weight and more suitable than an actual football for training indoors.

In another configuration, the training ball may simulate a rugby ball which, typically, is similar to a football but with a modified shape and size, as is known in the art. For example, the rugby ball has different dimensions—"international size" as used in competition is approximately 27 cm (11 in) long and 60 cm (24 in) in circumference at its widest point. Smaller-sized balls are used for junior versions of the game. Also, the ends of a rugby ball tend to be more rounded than an American football.

Punching Bag

Figure 12:
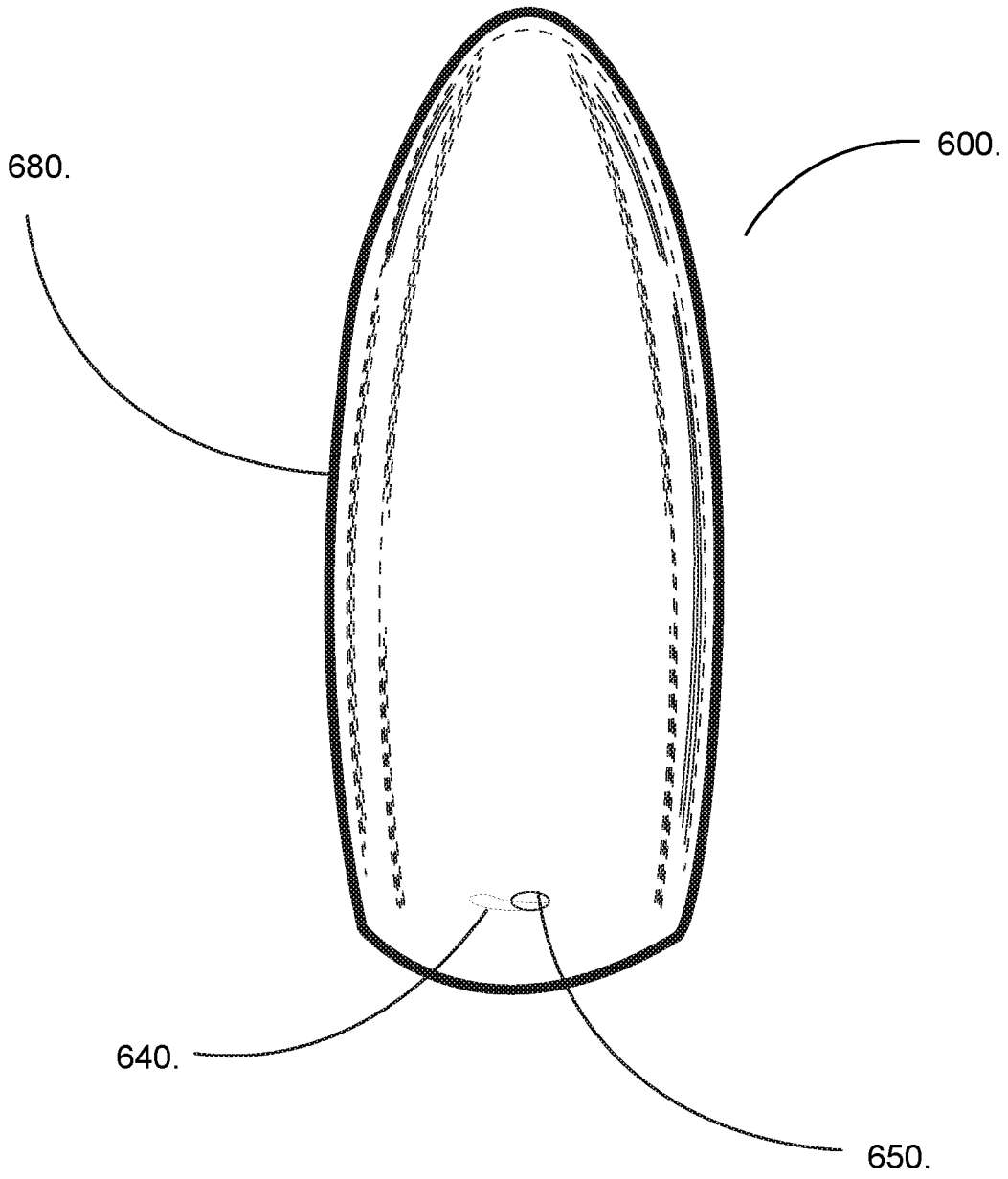
FIG. 12 is a punching bag embodiment of the present invention.
Figure 13:
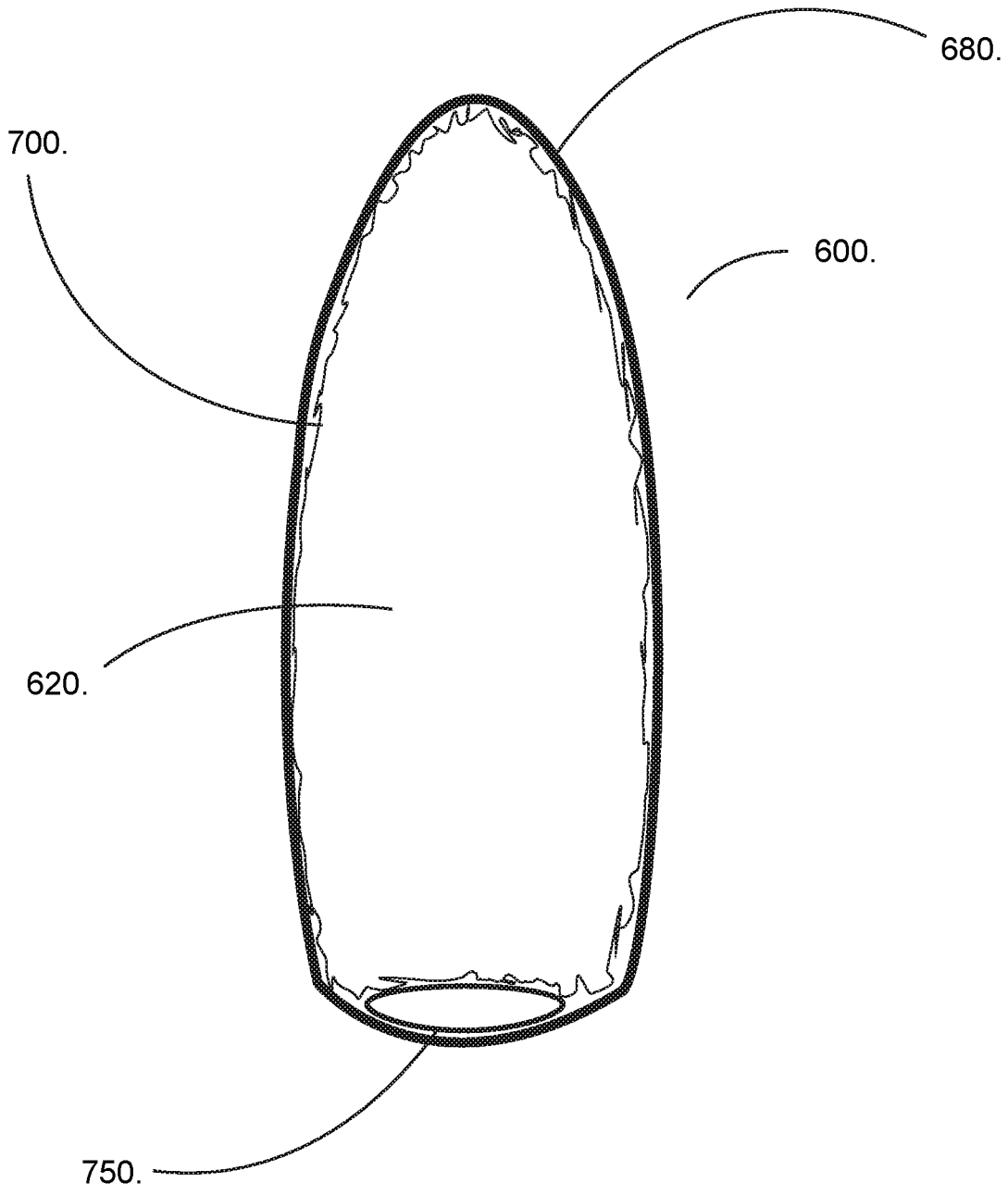
FIG. 13 is a cross-section of the punching bag of FIG. 12 illustrating the interior bladder within the exterior of the punching bag of FIG. 12.
Figure 14:
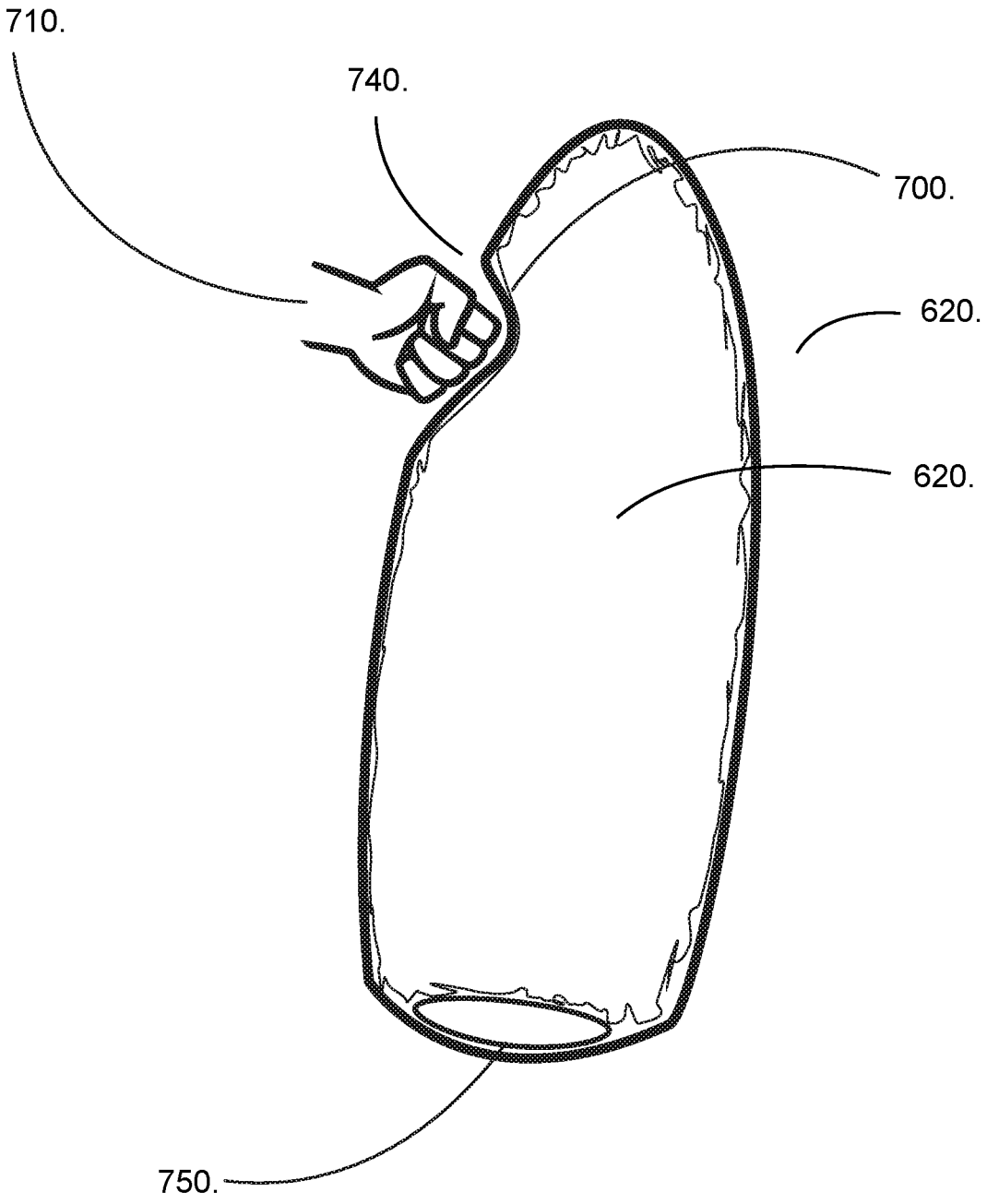
FIG. 14 is a cross-section illustrating the punching bag of FIG. 12 as it is being punched.
Figure 15:
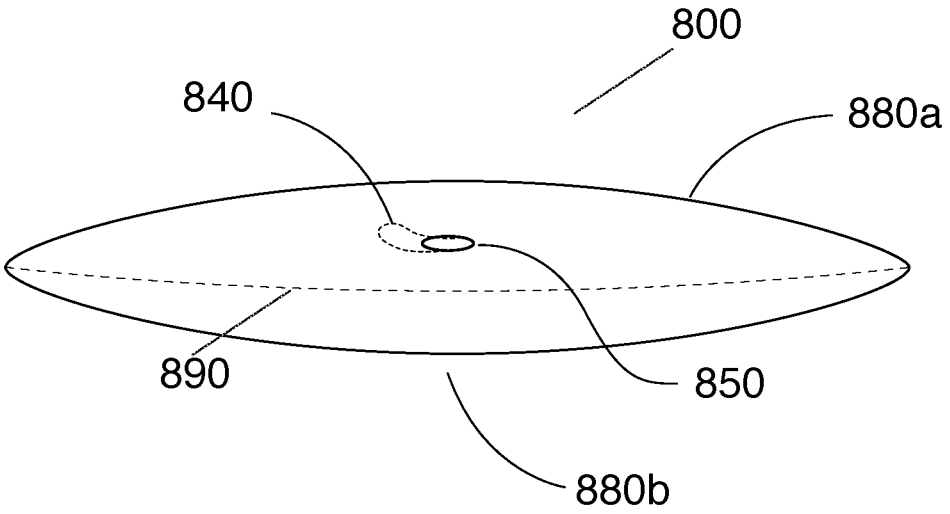
FIG. 15 is a side view of a flying disc embodiment according to the present invention.
Figure 16:
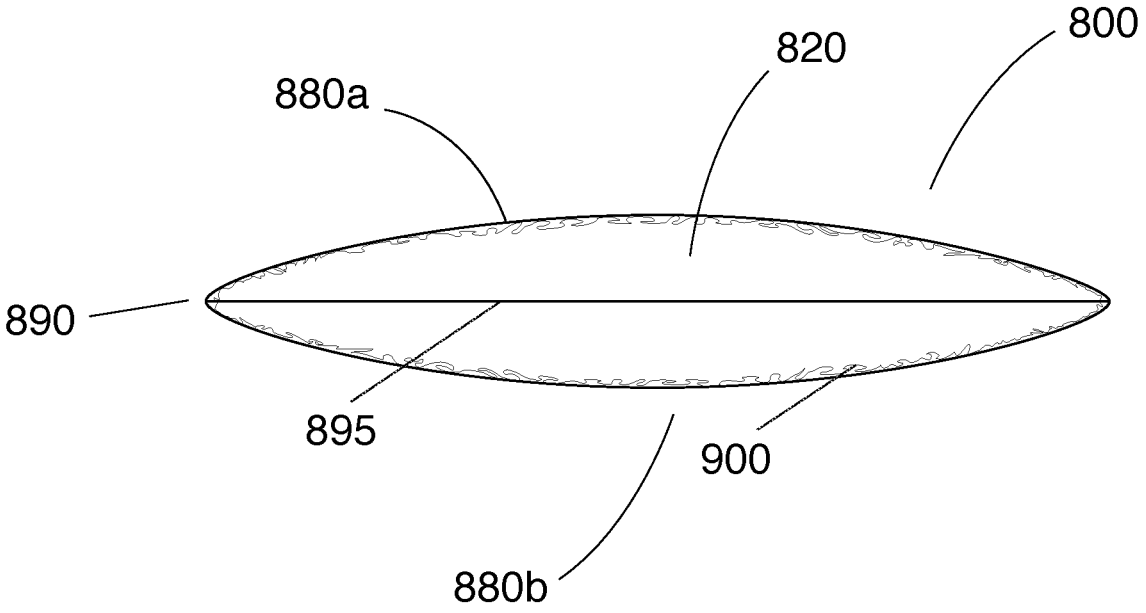
FIG. 16 is a cross-section of the flying disc of FIG. 15.
Figure 17:
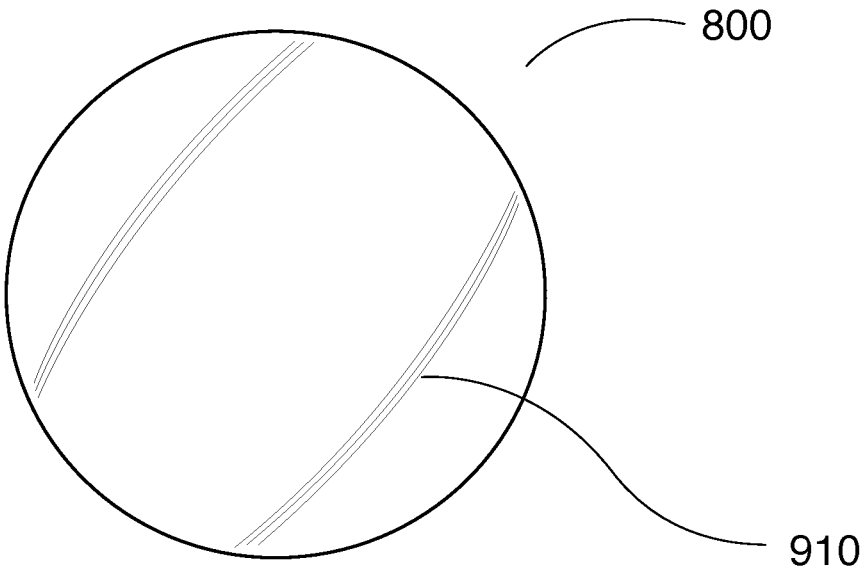
FIG. 17 is a top view of the flying disc of FIG. 15.

FIGS. 12-14 illustrate a punching bag embodiment of the invention. The bag is typically weighted at its bottom end, such as with a sandbag or other weight source, to keep the bag on the ground in a resting state and, preferably, after it is punched or kicked.

FIG. 12 illustrates a punching bag 600 having an outer layer 680, an inflation port 640, and an opening 650 in the outer layer 680 to access the inflation port 640. FIG. 13 is a cross-section of FIG. 12. An inner bladder 620 has an uneven, energy-absorbing surface 700 when inflated. On the bottom of the interior of the outer layer 680, there is a weight 750 that, in one embodiment, keeps the punching bag on the ground. The weight may be a weighted plate, a sandbag, or other known device for weighting down a lightweight structure. The outer layer 680 may include an interior pocket to hold weights or weighting material at location 750.

The energy-absorbing surface 700 absorbs energy when a user punches or kicks the bag 600. In this way, the punching bag may be kept lightweight and suitable for use indoors inside a house, for example, while minimizing the risk of breaking objects in the house.

In an alternative embodiment, the lower portion of the outer layer 680 may be secured to a weighted base unit that holds the punching bag to the floor. The outer layer may be sewn, adhered, heat welded, or otherwise attached to the weighted base unit and/or by other methods known in the art. The bladder may then extend the height of the punching bag, terminating at a lower end at the punching bag at the weighted base unit In a further alternative embodiment, the bag may be suspended from above, such as being hung from a hook. The bag may have an eyelet or other attachment arrangement to connect to the hook. It is expected that the bladder of the punching bag will be inflated with air and/or a heavy gas.

Beach Ball/Moon Ball

The present invention may extend to an oversized ball, such as a beach ball and/or "moon ball." The ball has an inner bladder, an outer layer, and an energy-absorbing layer in between. The energy-absorbing layer may be formed by using a bladder made of, for example, a metalized film. The bladder is sized to be larger than the outer layer, thereby creating a bunched, crinkled, pleated, and/or other uneven surface on the bladder.

In one embodiment, an oversized ball is a sphere and the exterior is printed and/or drawn with different colors to mimic the multi-colored look of a classic beach ball. In another embodiment, the ball is printed with the surface of the Moon or a planet.

The ball may be formed from multiple panels (e.g. as in FIG. 4, as a rough example), or otherwise formed into a sphere. The ball may be filled with air or, alternatively, a lighter weight gas that helps keep the ball aloft during use.

In one specific, non-limiting embodiment, an oversized ball may be approximately 45 inches in circumference and filled with a lightweight gas such as helium. This allows the ball to suspend in midair. The exterior of the ball may have an illustration in glow-in-the-dark ink that allows it to look and spin like the moon in the dark (a "Moon Ball"). Alternatively, the exterior of the ball may have other glow-in-the-dark patterns of printing or hand-drawing for a desired effect.

Flying Disc

A further alternative embodiment is a flying disc, similar in broad concept to a Frisbee®. Referring to FIGS. 15-18, a disc 800 according to the present invention includes an exterior layer 880*a, b* and an inner bladder (FIG. 16, 820), as previously described. The flying disc 800 is typically round, with a diameter several times greater that the height of the disc at the perimeter. As with other embodiments, the flying disc is lightweight so as to be usable indoors without damaging typical indoor fixtures and other items found indoors. The inner bladder 820 may be larger in dimension than the outer layer 880*a, b*, such that an energy-absorbing bunched up surface 900 of the inner bladder is created at the interface with the outer layer. Consequently, the bunched-up surface 900 of the inner bladder absorbs energy when the disc is caught and/or when it hits an object. Generally, for this and other embodiments, the bunched-up surface may result in a "crunch" sound when kicked, hit, caught, and/or making an impact on an object. Alternatively, a separate layer of crunched up material made with a metalized film, for example, may be interposed in between the bladder and the outer layer.

In one embodiment, the outer layer includes a generally circular upper layer 880*a* and a generally circular lower layer 880*b*. The layers may have the same diameter or, alternatively, one layer may have a great diameter than the other so as to create more of a curve on one surface of the disc than the other when the disc is complete. The two upper layers are joined together along an edge 890, such as by sewing, adhesive, heat bonding, and/or other sealing methods known in the art.

A steel spring wire loop 895 (FIG. 16) such as is used in pop up car shades, for example, extends about the perimeter on the interior of the disc. The wire maintains the shape of the disc. The spring steel wire loop 895 is also resilient so as to flex upon impact with an object. As alternatives to steel spring wire, constructions of rubber, a polymer, tubing or the like may extend around the interior of the edge of the disc to retain shape.

A generally disc-shaped bladder 820 made of a metalized film fills the interior. As in other embodiments of the invention, the bladder may have larger dimensions than the sealed outer layer, such that when the bladder 820 is inflated the surface 900 of the bladder becomes "crunched up," bunched, pleated, or the like in order to absorb energy upon impact. Alternatively, a separate layer of "crunched up" material or the like may be interposed in between the bladder and the exterior layer in order to absorb the energy upon impact. The impact may be from a user throwing or catching the disc, hitting or kicking the disc, the disc hitting an object, or in other situations in which the disc is impacted.

The materials may be selected to create lighter or heavier discs. For example, the interior resilient ring 895 about the edge of the interior of the disc may be adjusted to make the flying disc heavier or lighter by altering the dimensions of the ring and/or selecting a lighter or heavier material. Further, the gas with which the bladder is filled is preferably helium, for example, to foster a lightweight disc. Alternatively, a heavier gas such as air may be user to weight the disc.

As with other embodiments, the exterior surface of the disc may include printing 910 (FIG. 17), which may be done by machine and/or printed by hand. In some embodiments, the exterior surface of the disc is highly customizable, such that a user may draw a variety of shapes, lettering, etc. on the exterior of the disc, using markers or other instruments of various colors and sizes.

Hacky Sack

Alternatively, a device according to the present invention may be similar to a hacky sack or footbag. The regulation version is a small, often round bag filled with dry grain (e.g. rice) or sand, which is kicked into the air and requires dexterity. In one embodiment, the hacky sack according to the present invention has an outer covering and an inflated bladder that bunches up against at least most of the inner surface of the outer covering. No additional material is in between the inner bladder and outer layer, and no additional filler material or stuffing is inside the inner bladder. In this embodiment, it may be desirable to use a heavier outer cover material than Tyvek 1443R, for example, in order to keep the hacky sack from travelling relatively far from the foot kicking it. Materials known in the art may be chosen for the outer covering, for example, to create the type of movement a designer wishes in a particular embodiment of the hacky sack.

Alternatively, the hacky sack may be weighted by, for example, adding material inside the inner bladder, such as dry grain, sand, foam or plastic balls, or other material, and/or adding weighting material in between the inner bladder and outer layer. Alternatively, the outer layer itself may be weighted, as with a polymer covering, spots or areas of material heat sealed or otherwise attached to areas of the outer covering, or the like—either on the interior surface of the outer covering or exterior surface. Similarly, the inner bladder may be weighted either with weighting that is secured to or integral with the exterior or interior of the bladder. Alternatively, in specialty embodiments, for example, the exterior could be crocheted or knitted or the like to form the outer covering and/or to cover the outer covering. The crocheted or knitted or the like material may add the desired weighting.

OTHER EMBODIMENTS

The present inventive concepts may be extending to other embodiments, such as bodysuits, articles of clothing, shirts, armbands, baseball bats, clubs, boxing gloves, and other items in which an inflatable inner bladder that bunches up against the inner surface of an exterior layer may be useful. This permits a wide variety of indoor games and sports to be played. Weighting material, protective material, securing mechanisms (e.g. Velcro straps/pads or other arrangements to secure a boxing glove to an arm, etc.) and the like may be added, as appropriate. For example, the present invention may be extended to the upper portion of a shoe or boot which may optionally be oversized, and have a more conventional slipper or shoe sole on the bottom for contact with the floor. Other embodiments may be imagined.

Exterior Printing and/or Hand Drawing

In another embodiment, the exterior of the ball and/or apparatus according to the present invention can be customized through printing on the outer shell. The printing may be done with a printer or by hand. For example, the outer shell may be printed or hand drawn to create the appearance that the ball is a soccer ball, a volleyball, a football, a punching bag, or the like. In one example, the exterior of the ball includes an outline drawing and a user then uses permanent, water-based and/or other markers, crayons or other marking devices to customize the appearance of the ball themselves, analogous to coloring in a coloring book. Alternatively, the user may customize the ball freestyle, without drawing within an outline drawing. The types of things that may be printed and/or hand drawn are unlimited. A few non-limiting examples include names, team names, numbers, phrases, figures, faces, cartoons, and the like. If printed with a printer or printing process, an unlimited number of things may be printed on the surface of the outer layer.

As a further alternative, the outer layer may be created with 3D printing, such that texture, indentations, raised indicia, and the like may be printed as an integral part of the structure of the outer layer—both on the exterior of the outer layer and, potentially, on the interior of the outer layer.

Embodiments may be more buoyant in air than the corresponding regulation ball. That is, for example, a football version of the present invention may be more buoyant in air than a regulation football of the same dimension. This can give the ball an "anti-gravity" effect. The buoyancy may be as great as neutral—in which case the "anti-gravity" effect would be pronounced. But most embodiments will have less-than-neutral buoyancy in air, such that the ball will fall to the ground when dropped, but may fall more slowly than a regulation ball. The buoyancy can be controlled by, for example, the type of gas(es) used to fill the inner balloon. Consequently, the ball may be made to have significant hang time (e.g. filled with helium or other lighter-than-air gas or mix of gasses) or less hang time (e.g. filled with air), as desired. As a further alternative, the ball may be designed to have a buoyancy approximately the same as a regulation ball to simulate the rise and fall of a regulation ball.

In an alternative embodiment, a lightweight energy-absorbing layer is provided in between the inner bladder and the outer casing. For example, a layer of rumpled or crunched-up metallized material such as Mylar or other lightweight energy-absorbing material may be provided in between the inner bladder and outer casing such that the inner bladder need not be bunched up against an inner surface of the outer casing. The layer of lightweight energy-absorbing material serves to absorb energy upon impact from a kick, punch, hit or the like. This layer may optionally be secured to the inner surface of the outer casing and/or to the exterior surface of the inner bladder, such as with adhesive or other attachment means.

Figure 6:
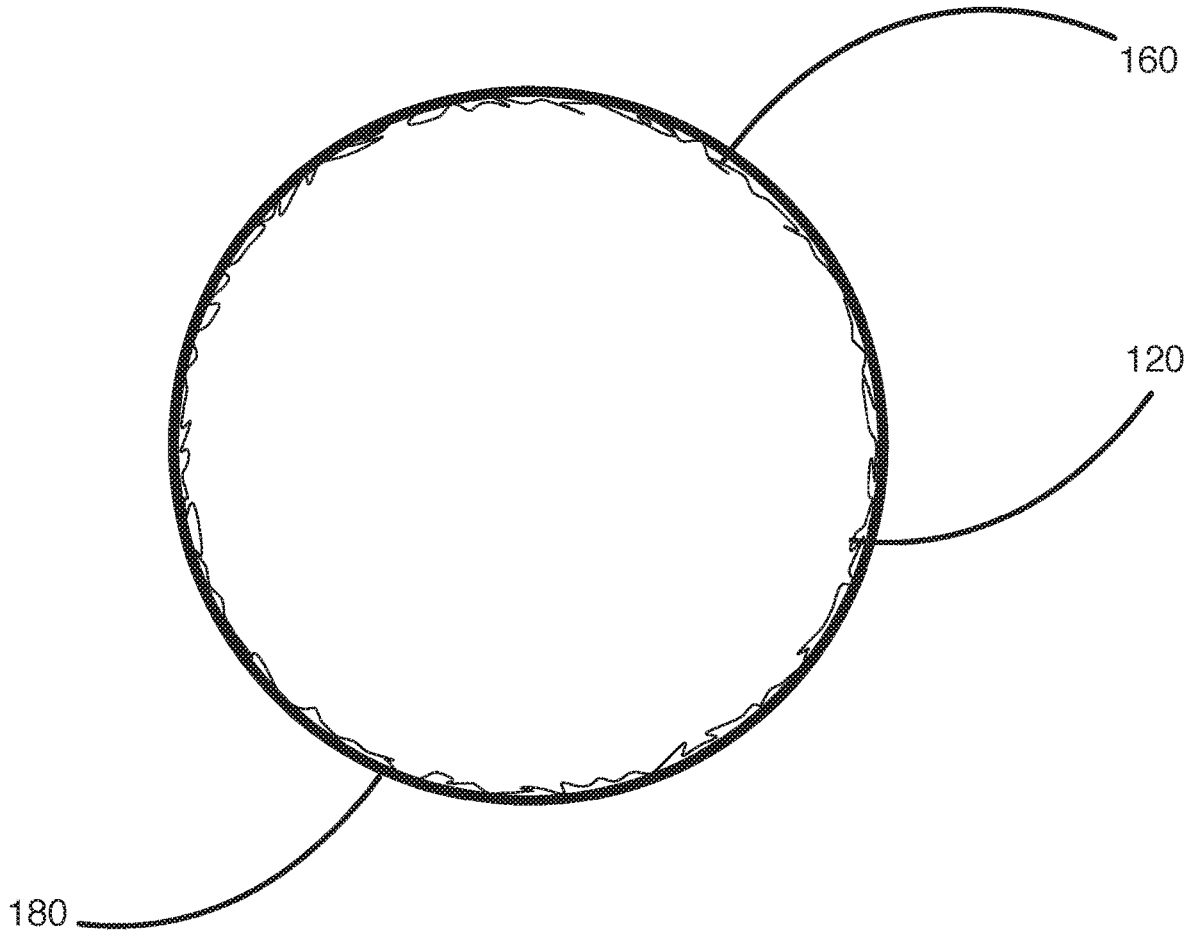
FIG. 6 is a cross-section of a ball illustrating a bunched up surface of the inner bladder against the inner surface of the outer layer.

Considering further optional aspects of embodiments of the design, the inner bladder may be bunched up against at least most of or all of the inner surface of the outer layer, as seen in FIGS. 6-8. In some embodiments, there is no additional material in between the inner bladder and outer layer (e.g., FIGS. 6-8, but applicable to other embodiments of the invention). There may also be no additional filler material or stuffing inside the inner bladder (e.g. FIGS. 6-8, also applicable to other embodiments of the invention). In some embodiments, an inflated inner bladder when unconstrained by the outer layer has a different shape than the inflated outer layer.

The balls of the present invention may be provided in conjunction with an instructive or training video, provided on a DVD, online, or the like. The instructive video may present tips, tricks, drills, and/or other material useful to the end user. Consequently, the present invention encompasses using the ball in conjunction with a training video.

In view of the many possible embodiments to which the disclosed principles may be applied, it should be recognized that the illustrated embodiments are only preferred examples and should not be taken as limiting the scope of the disclosure. Rather, the scope is defined by the following claims. We therefore claim all that comes within the scope and spirit of these claims.

What is claimed is:

1. A lightweight device for training and/or play, comprising:

a flexible outer layer having an inner surface;

an inflatable inner bladder inside the outer layer;

the inflated inner bladder when unconstrained by the outer layer having a different shape than the inflated outer layer;

the outer surface of the inner bladder when inflated being adapted to be bunched up or folded against most of the inner surface of the outer layer; and upon impact, a portion of the bunched up or folded outer surface of the inner bladder being adapted to change configuration to absorb energy at an area of impact; wherein:

the inner bladder when unconstrained by the outer layer has a maximum dimension at least 1.25 times greater than the maximum dimension of the outer layer;

wherein there is no filler material or stuffing within the inner bladder;

and the inner bladder comprises boPET.

2. The device of claim 1, wherein the device is one of a simulated soccer ball, football, rugby ball, volleyball, baseball, softball, tennis ball, beachball, golf ban, flying disc, and punching bag.

3. The device of claim 1 wherein the outer layer is a soft, tear-resistant, fabric-like material.

4. The device of claim 1, wherein the device is a flying disc comprising a generally circular upper outer layer, a generally circular lower outer layer, and an interior bladder, the upper and lower outer layers being joined at the edges.

5. The device of claim 4, wherein the circular edge of the disc is reinforced with a generally circular resilient ring extending about the edge of the disc on the interior of the device.

6. The device of claim 1, wherein the device is a weighted punching bag, further comprising a weighted lower portion adapted to keep the punching bag on the ground and/or to limit the travel of the punching bag upon impact.

7. The device of claim 1, wherein there is a flexible cover around the outer flexible layer.

8. The device of claim 1, wherein the outer surface of the outer layer is adapted to receive and retain marking from markers and crayons.

9. The device of claim 1 wherein the bunched up or folded inner bladder creates an uneven surface on at least part of the outer layer, the uneven surface adapted to alter movement of the device as it travels through air.

10. A lightweight device for training and/or play, comprising: a flexible outer layer having a diameter;

an inflatable inner bladder, the inner bladder being made of a material and having a maximum diameter when the inner bladder is unconstrained that is sufficiently greater than the maximum diameter of the outer layer such that when the inner bladder is inside the outer layer, the inner bladder is adapted to bunch up or fold against the inner surface of the outer layer upon inflation of the inner bladder;

the outer surface of the inner bladder being bunched up or folded against at least most of the inner surf ace of the outer layer; and the bunched up or folded outer surface of the inner bladder being adapted to at least partially change configuration to absorb energy upon impact at an area of impact;

wherein the device has a circumference of at least 68 cm and weighs less than about 3 ounces;

wherein there is no filler material or stuffing within the inner bladder.

11. A lightweight device as defined in claim 10, wherein the inner bladder when unconstrained by the outer layer has a maximum dimension at least 1.25 times greater than the maximum dimension of the outer layer.

12. The device of claim 10, wherein the device is one of a simulated soccer ball, football, volleyball, baseball, softball, tennis ball, beachball, golf ball, and flying disc.

13. A lightweight device for training and/or play, comprising: a flexible, tear-resistant outer layer having a diameter;

an inflatable inner bladder;

at least portions of the outer surface of the inner bladder when inflated being bunched up or folded against the inner surface of the outer layer;

the bunched up outer surface of the inner bladder being adapted to absorb energy upon impact at an area of impact;

wherein there is no filler material or stuffing within the inner bladder;

wherein the inner bladder has an unconstrained maximum dimension at least 1.25 times greater than the maximum dimension of the outer layer.

14. The device of claim 13, wherein the device is one of a simulated soccer ball, football, rugby ball, volleyball, baseball, softball, tennis ball, beachball, golf ban, flying disc, and punching bag.

15. The device of claim 13 wherein the outer layer is a soft, tear-resistant, fabric-like material.

16. The device of claim 13, wherein the device is a flying disc comprising a generally circular upper outer surface portion, a generally circular lower outer surface portion, the upper and lower outer surface portions being joined at the edges.

17. The device of claim 16, wherein the circular edge of the disc is reinforced with a generally circular resilient ring extending about the edge of the disc on the interior of the device.

18. The device of claim 13, wherein the device is a weighted punching bag, comprising an outer layer, an inner bladder, and a weighted lower portion adapted to keep the punching bag on the ground and/or to limit the travel of the punching bag upon impact.

19. The device of claim 13, wherein there is a flexible cover around the outer flexible layer.

20. The device of claim 13 wherein the bunched up or folded inner bladder creates an uneven surface on at least part of the outer layer, the uneven surface adapted to alter movement of the device as it travels through air.

* * * * *